United States Patent [19]

German, Jr.

[11] 4,308,617

[45] Dec. 29, 1981

[54] NOISELIKE AMPLITUDE AND PHASE MODULATION CODING FOR SPREAD SPECTRUM TRANSMISSIONS

[75] Inventor: Edgar H. German, Jr., Baltimore, Md.

[73] Assignee: The Bendix Corporation, Southfield, Mich.

[21] Appl. No.: 848,858

[22] Filed: Nov. 7, 1977

[51] Int. Cl.[3] ..... H04K 1/00

[52] U.S. Cl. ..... 375/1; 455/26

[58] Field of Search ..... 325/32, 34, 122; 178/22; 179/1.5 E; 375/1, 2; 455/26; 364/717

[56] References Cited

U.S. PATENT DOCUMENTS

| | | | |
|---|---|---|---|
| 2,961,482 | 11/1960 | Wieselman et al. | 325/32 |
| 3,366,779 | 1/1968 | Catherall et al. | 178/22 |
| 3,518,547 | 6/1970 | Filipowsky | 325/32 |
| 3,714,573 | 1/1973 | Grossman | 325/32 |
| 3,728,529 | 4/1973 | Kartchner et al. | 364/717 |
| 3,731,198 | 5/1973 | Blasbalg | 325/32 |
| 3,808,536 | 4/1974 | Reynolds | 325/32 |
| 4,225,935 | 9/1980 | Zscheile et al. | 375/1 |

OTHER PUBLICATIONS

*IBM Journal*, "A Comparison of Pseudo-Noise and Coventional Modulation for . . . Communications", by Blasbalg, Jul. 1965, pp. 241-255.

*Primary Examiner*—Howard A. Birmiel

*Attorney, Agent, or Firm*—W. G. Christoforo; Bruce L. Lamb

[57] ABSTRACT

A plurality of binary pseudo noise generators are used to develop a Gaussian code that appears thermal noise-like in both amplitude and phase. Half of the pseudo noise generators are provided in an in-phase section and half in a quadrature section, with each said generator output being mixed with data to be transmitted and applied to modulate a carrier, the outputs from the various sections being combined for transmission. A receiver having the same number of pseudo noise generators and generating the same code synchronously demodulates the received data.

10 Claims, 7 Drawing Figures

DATA
20
CLOCK
18
MODULO 2 ADDERS
22
23
24
25
26
27
28
29
30
CARRIER GENERATOR
MIXERS
32
36
40
-90°
42
44
HARMONIC FILTER ωc
S(t)
1ST PN GENERATOR
10
IN-PHASE
11
NTH PN GENERATOR
12
9
1ST PN GENERATOR
14
QUADRATURE
15
NTH PN GENERATOR
16
13
RECEIVED SIGNAL ωc
60
62
68
+90°
LOCAL OSCILLATOR ωc
LOW PASS
64
LOW PASS
66
BASEBAND SIGNAL COMPONENTS
$I_S = Re\{u(t)e^{i\phi}\}$
$Q_S = \mathcal{I}m\{u(t)e^{i\phi}\}$ N=6
.3125 (.33)
.234 (.233)
.094 (.086)
.0156 (.016)
.234 (.233)
.094 (.086)
.0156 (.016)
0
2
4
6 Ap
-2
-4
-6 -Ap

NOISELIKE AMPLITUDE AND PHASE MODULATION CODING FOR SPREAD SPECTRUM TRANSMISSIONS

The Government has rights in this invention pursuant to Contract No. MDA904-76-C-0521, awarded by the Maryland Procurement Office, Ft. George G. Meade, Md.

BACKGROUND OF THE INVENTION

This invention relates to secure communication systems and particularly to such systems using a spread spectrum.

Methods of phase modulating a carrier using pseudo noise generators have been used to provide secure communications. Basically, such systems employ means to continuously vary the phase of a data modulated carrier in accordance with a pseudo random code, thereby expanding or spreading the spectrum of the carrier so that an intercept system sees only a noiselike spectrum. A receiver having knowledge of the pseudo random code can easily extract the data. In addition, an intercept system not having knowledge of the pseudo random code can use a square law or higher order detector to collapse the intercepted signal into a second harmonic carrier, thus exposing the fact that a carrier has been transmitted and the basic carrier frequency. Thereafter, the data can possibly be extracted illicitly using known decoding techniques.

SUMMARY OF THE INVENTION

The present invention comprises means for coding a transmitted carrier, preferably data modulated, in both amplitude and phase so that the resulting received signal is thermal noiselike in the Gaussian sense with a spread spectrum. This is accomplished by providing 2 N binary pseudo noise generators arranged in in-phase and quadrature sections of N pseudo noise generators each. The output signals from each pseudo noise generator is modulated with data to be transmitted and the resulting signal used to modulate a carrier, directly in the inphase section and with a 90 degree phase shift in the quadrature section. All modulated carriers are then combined and transmitted through a harmonic filter in the standard manner.

A suitable receiver which has knowledge of the pseudo noise code also has 2 N pseudo noise generators arranged as N pseudo noise generators in in-phase and quadrature sections, respectively. Carrier demodulation or correlation to recover the signal data is a similar process to the encoding process at the transmitter, whereby the pseudo noise code is mixed with the in-phase and quadrature components of the received signal to produce, for example, in-phase and quadrature signals for phase locking and data demodulation by, for example, a Costas loop and an integrate and dump circuit. Correlation can also be performed at IF or baseband as for any other pseudo noise technique.

It is an object of this invention to provide means for coding a carrier which is subsequently seen by an intercepting receiver as Gaussian noise.

It is another object of this invention to provide means for coding a data modulated signal which is seen by an intercepting receiver as Gaussian noise.

It is a further object of this invention to provide a data modulated coded carrier which is seen by an intercepting receiver as Gaussian noise over a relatively wide spectrum and which cannot be detected by a square law or higher order detector.

DESCRIPTION OF THE PREFERRED EMBODIMENT

Figures 1, 2, 7:
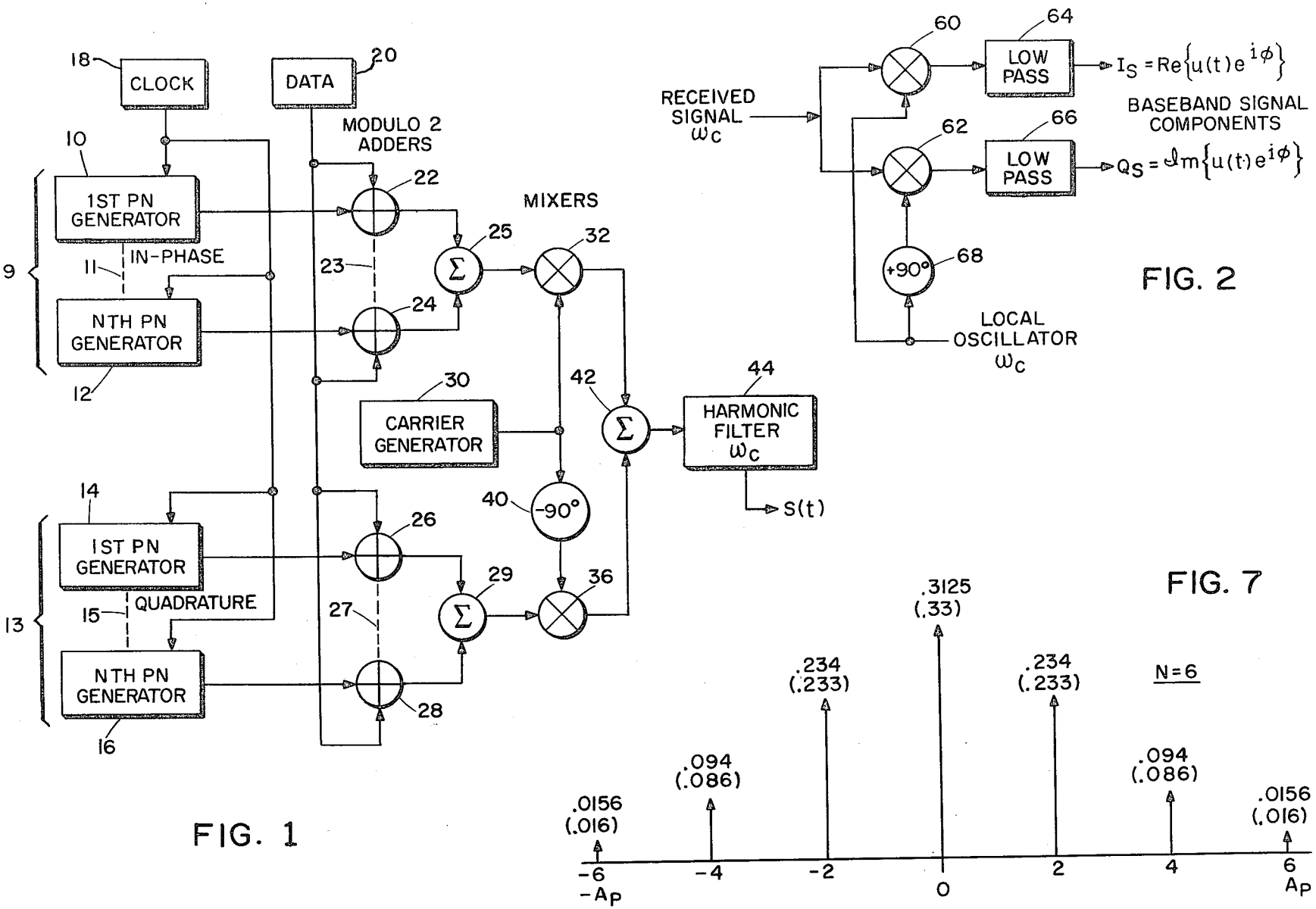
FIG. 1 is a simplified block diagram of a typical transmitter built in accordance with the principles of the invention.
FIG. 2 is a block diagram of means found in the receiver for separating the received signal into its in-phase and quadrature baseband signal components.
FIG. 7 is similar to FIG. 6 except that N is equal to 6.
Figure 4:
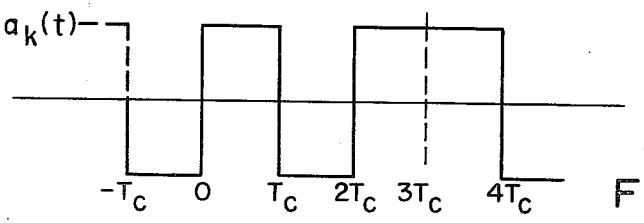
FIG. 4 shows the waveform generated by a typical one of the pseudo noise generators of the invention.

Referring first to FIG. 1, an in-phase section 9 of pseudo noise (PN) generators is seen to be comprised of N-PN generators including a first generator 10 and a last or $N^{th}$ generator 12 and intermediate generators represented by dash line 11. In like manner, a quadrature section 13 is comprised of N-PN generators including a first generator 14 and a last or $N^{th}$ generator 16 with intermediate generators in this section being represented by dash line 15. Preferably, each PN generator is simply a binary recirculating shift register with linear feedback which generates at its output a serial stream of ones and zeroes in response to clock pulses from clock 18. Each PN generator is preloaded with a predetermined binary code which is preferably different for each of the PN generators. A typical code issuing from a PN generator is shown at FIG. 4, reference to which figure should now be made. In FIG. 4, duration $T_c$ is known as chip time and is equal to the time between pulses issuing from clock 18. In each case, the bit string issuing from a PN generator is pseudo random in nature as implied by FIG. 4. Since the pulse streams are pseudo random in nature, the output from each generator is a mean zero and since each generator is preferably coded with a separate code they are decorrelated with respect to each other.

The output stream from each PN generator is applied to an associated modulo 2 adder which includes adders 22 and 24 shown in FIG. 1 and the additional adders implied by dash line 23 for the in-phase section and adders 26 and 28 and the additional adders implied by dash line 27 in the quadrature section. The bit stream or code issuing from a PN generator is added to binary data from a source 20 in the various associated modulo 2 adders. The resulting bit streams from all in-phase modulo 2 adders are combined in a summing network 25. All quadrature output streams are similarly combined in summing network 29. It should be understood that the chip rate is very much faster than the data rate. For example, in a device actually built the chip rate was about 5 MHz while the data rate was about 16,000 bits per second. In other words, each data bit is encoded on approximately 300 contiguous bits issuing from an associated PN generator.

A generator 30 provides a carrier frequency which is applied to mixer 32 in in-phase section 9 and as phase shifted 90 degrees in element 40 to mixer 36 in quadrature section 13. The carrier as applied to the various mixers is mixed with the output from their associated modular 2 adders with the output from all the mixers being combined in adder 42 whose output is passed through harmonic filter 44 for transmission.

Figure 5:
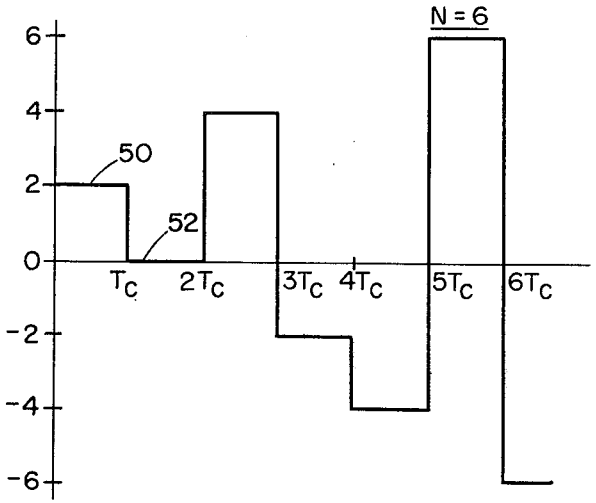
FIG. 5 shows the waveform of a typical code generated by N pseudo noise generators.

Refer now to FIG. 5 which shows a typical video portion of the in-phase (or quadrature) component of a signal issuing from summing network 25 (or 29) of FIG. 1, assuming no data is modulated thereon and assuming further that N is equal to 6. Since, as previously discussed, the outputs from each of the PN generators has a mean zero value, the sum of these outputs also will have a mean zero output and will vary in a pseudo random fashion just as each of the individual PN generator outputs varies in a pseudo random fashion. As an example of how the waveform of FIG. 5 is generated, take pulse 50 which has an amplitude of 2. In this case, 4 of the PN generators will be generating a plus 1 output while 2 of the PN generators will be generating a minus 1 output, the sum of the total being plus 2. As another example, take pulse 52 which has a value of 0, indicating that 3 PN generators are generating a plus 1 output and 3 are generating a minus 1 output. Of course, for the example illustrated, that is where N is equal to 6, the discrete values of the signal can be only 0, plus or minus 2, plus or minus 4, or plus or minus 6.

In analyzing the modulation characteristics of the transmitted signal, s(t), of FIG. 1, we first look at the bandpass signal representation of modulation. The modulated carrier or signal s(t) can be represented in terms of in-phase and quadrature components by $$s(t)=x(t)\cos\omega_c t-y(t)\sin\omega_c t$$

or in complex notation for convenience by $$s(t)=\tfrac{1}{2}u(t)\exp i\,\omega_c t+\text{complex conjugate (C.C.)}$$

where $x(t)$ = in-phase modulation
$y(t)$ = quadrature modulation and $$u(t) = x(t) + iy(t)$$

= complex modulation $\omega_c$ = carrier frequency in radians/second.

For simple binary PN modulation the complex modulation is given by $$u(t) = e^{\frac{i2\pi}{N_1}m};\ m = 0, 1 \text{ over a chip time } T_c$$
$$N_1 = 2$$

with an auto-correlation function (assuming independent equi-likely 0, 1 states)

$$R_a(\tau) = \begin{cases} 1 - \frac{|\tau|}{T_c}, & |\tau| < T_c \\ 0, & \text{otherwise} \end{cases}$$

equal to that of a single PN generator, and a spectrum $$S_a(\omega) = T_c \frac{\sin^2\left(\frac{\omega T_c}{2}\right)}{\left(\frac{\omega T_c}{2}\right)}$$

To generalize to a summation of N-PN generators for both in-phase and quadrature components, let the modulation be $$x(t) = \frac{A_p}{\sqrt{2N}} \sum_{k=0}^{N-1} a_k(t)$$

$$y(t) = \frac{A_p}{\sqrt{2N}} \sum_{k=0}^{N-1} b_k(t)$$

where $A_p$ = Peak value of carrier $N$ = Number of in-phase (or quadrature) *PN* Generators $a_k(t), b_k(t)$ = $k^{th}$ in-phase (or quadrature) generator.

The generators produce a "random" string of $\pm 1$'s each with a duration $T_c$ as was seen in FIG. 4.

Since, as previously mentioned, all the generators have mean zero output and are decorrelated with each other, each then has the simple binary correlation $R_a(\tau)$ given above. Mathematically $$\langle a_k\rangle = \langle b_k\rangle = 0$$

$$\langle a_k b_j\rangle = 0 \text{ for all } k, j$$

$$\langle a_k a_j\rangle = R_a(\tau)\delta_{kj};\ \delta_{kj} = \begin{cases} 1, & k = j \\ 0, & k \neq j \end{cases}$$

$$\langle b_k b_j\rangle = R_a(\tau)\delta_{kj}$$

where $\langle . \rangle$ denotes averages or expectations.

Next, looking at the probability density of the modulation components, consider that the in-phase component of modulation is given by the functional relationship $$x(t) = \frac{A_p}{\sqrt{2N}} \sum_{k=0}^{N-1} a_k(t)$$

where $a_k(t) = \pm 1$ with equi-probability ($p_{\pm 1} = \frac{1}{2}$). The $a_k(t)$'s are also assumed to be independent. Of course, the above relationship also is true for the quadrature component y(t) and the below mathematical development is valid for either x(t) or y(t).

The distribution of x(t) at a given instant can be translated to the problem of obtaining n heads in N tosses of a coin where N, as before, is the number of PN generators in the in-phase or quadrature section of the block diagram of FIG. 1. Define a new symbol $a_k$ where $$\bar{a}_k = \begin{cases} 1, \text{ head} \\ 0, \text{ tail} \end{cases}$$

with $p_+$ = probability of a head $p_- = 1 - p_+$ = probability of a tail.

Note that $$a_k(t) = 2\bar{a}_k - 1.$$

Then the sum $S_n$ represents n heads in N tries:

$$S_n = \sum_{k=0}^{N-1} \bar{a}_k$$

gives $$S_n = 0, 1, \ldots, N.$$

Similarly for the PN codes $$X_n = \sum_{k=0}^{N-1} a_k(t)$$

gives $$X_n = -N, -(N-2), \ldots (N-2), N.$$

The PN code sum and the coin head sum have a one-to-one correspondence as $$X_n = 2S_n - N.$$

Therefore, computing the probability of n heads is the same as computing the probability of the modulation component states. It is well known that the probability of throwing exactly n heads in N tries is the binomial distribution (which becomes Gaussian for N large)

$$\text{Prob}\,(S_n = n) = \frac{N!}{n!(N-n)!} p_+^{\,n} (1 - p_+)^{N-n}.$$

For equi-likely states ($p_+ = p_- = \frac{1}{2}$), average and rms values can be easily found. Now the mean or average is $$< X_n > = \sum_{k=0}^{N-1} 2 < \bar{a}_k > - N$$
$$= 0$$

as $$<\bar{a}_k> = p_+ \times 1 + p_- \times (0)$$
$$= \tfrac{1}{2}$$

and the variance is:

$$<X_n^2> - <X_n>^2 = 4 \sum_{k=0}^{N=1} \sum_{j=0}^{N=1} \bar{a}_k \bar{a}_j$$

-continued $$- 4N \sum_{k=0}^{N-1} <a_k>$$
$$+ N^2$$

and as $$<\bar{a}_k \bar{a}_j> = \begin{cases} \tfrac{1}{4}, k \neq j \\ \tfrac{1}{2}, k = j \end{cases}$$

then $$<X_n^2> = 2N + 4(N)(N-1) \times \tfrac{1}{4} - 2N^2 + N^2$$
$$= N$$

with an rms value $\sqrt{N}$.

Now x(t) differs only by multiplicative constants. Therefore the average of x(t) is $$<x(t)> = 0$$

with an average power $$<x(t)^2> = A_p^2/2N$$

The total power in the transmitted signal is $$P_{AV} = \tfrac{1}{2} <x(t)^2 + y(t)^2>$$
$$= \frac{A_p 2}{2N}$$

as y(t), the quadrature modulation, is independent of the in-phase modulation.

Figure 6:
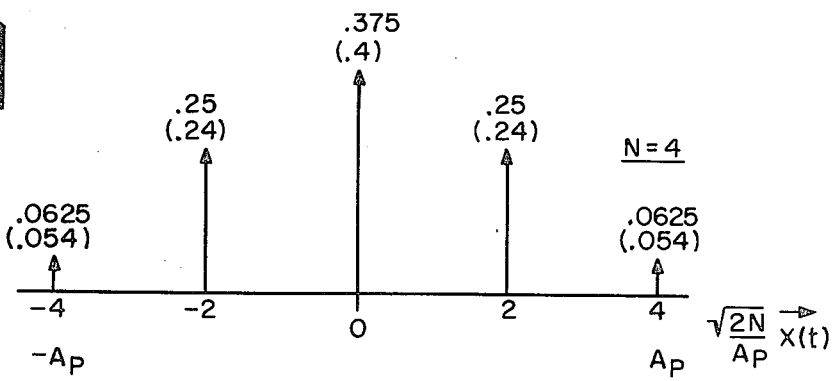
FIG. 6 shows the spectrum lines of the in-phase component of the transmitted code where N is equal to 4 as compared to a Gaussian distribution.

As shown above, the in-phase and quadrature amplitudes x(t) and y(t) are binomially distributed at any instant of time. This distribution becomes Gaussian for a large number of PN generators. For example, FIG. 6, reference to which should now be made, shows the distribution of x(t) for typical cases where N=4, with the true Gaussian amplitude shown in brackets for comparison. In like manner, FIG. 7 shows the distribution of x(t) for typical cases where N=6, again with the true Gaussian amplitudes shown in brackets for comparison.

The mean value of the modulation components was shown to be zero above. More interestingly, the average power in a component is found to be $$<x^2(t)> = \frac{A_p 2}{2N}$$

$$<y^2(t)> = \frac{A_p 2}{2N}$$

with the total average transmitted power given by $$P_{AV} = \tfrac{1}{2} <x^2(t) + y^2(t)>$$
$$= \frac{A_p 2}{2N}.$$

As the number of PN generators increases, the average power out of the transmitter decreases from a maximum possible of $A_P^2/2$. Namely, an increase in dynamic range of the transmitter is necessary over that of the continuous wave maximum power case.

The spectrum of the modulation can be found as the Fourier transform of the auto-correlation of the modulation. Within a proportionality constant this spectrum is found to be identical to that of a single PN generator. Similarly, the auto-correlation function is that of a single generator.

The spectrum is given by $$S_u(\omega) = \int_{-\infty}^{\infty} R_u(\tau)\, e^{-i\omega\tau} d\tau$$

$$= \frac{A_p 2}{N} T_c \frac{\sin^2\left(\frac{\omega T_c}{2}\right)}{\left(\frac{\omega T_c}{2}\right)}$$

where $\omega$ is the frequency in radians/second. The auto-correlation function is $$R_u(\tau) = \begin{cases} 1 - \frac{|\tau|}{T_c}, & |\tau| < T_c \\ 0, \text{ otherwise.} \end{cases}$$

The carrier demodulation of the chip code is performed by a "conjugate" mixing process at a receiver whose structure should now be obvious to one skilled in the art. This process is simply mixing the code, generated in the same manner as in transmitting, with the receiver local signal quadrature component advanced by 90 degrees (remember, the transmitter local signal quadrature component was retarded by 90 degrees as seen in FIG. 1).

After mixing, the output of the correlation may be considered as consisting of three parts 1. Signal mixing with code and producing a "collapsed" carrier (IF).
2. Demodulation noise produced by the signal amplitude modulation with a spread spectrum.
3. Receiver noise mixing with the local code and producing a noise over the RF(IF) bandwidth.

The demodulation noise is unique to amplitude coding; it is not found in ideal phase modulation coding. It places an upper limit on the detected signal-to-noise ratio on the order of the TW product, or "processing gain". Here, "T" is the integration time or reciprocal of the data bit rate B (in Hertz). W is the chip rate or code symbol rate $1/T_c$.

Refer now to FIG. 2 which shows how the signal as intercepted by a receiver is separated into its in-phase and quadrature components at baseband. Simply, the received signal at the carrier frequency $W_c$ is applied to mixers 60 and 62 where it is mixed with the local oscillator (not shown) output signal: at the carrier frequency $W_c$ in in-phase mixer 60 and with the local oscillator output signal advanced by 90 degrees by phase shifter 68 in mixer 62. The output signals from mixers 60 and 62, respectively, are passed through essentially identical low pass filters 64 and 66, respectively, each said filter having a bandwidth BW greater than the chip rate, or $$BW > 1/T_c,\ W = 1/T_c$$

where W is the chip rate or clock rate of clock 18 seen in FIG. 1.

The resulting in-phase baseband and quadrature signal components, respectively, $I_s$ and $Q_s$ are:

$$I_s = Re\,\{\mu(t)e^{i\phi}\}$$

$$Q_s = Im\,\{\mu(t)e^{i\phi}\}$$

where Re designates the real part and Im designates the imaginary part.

Figure 3:
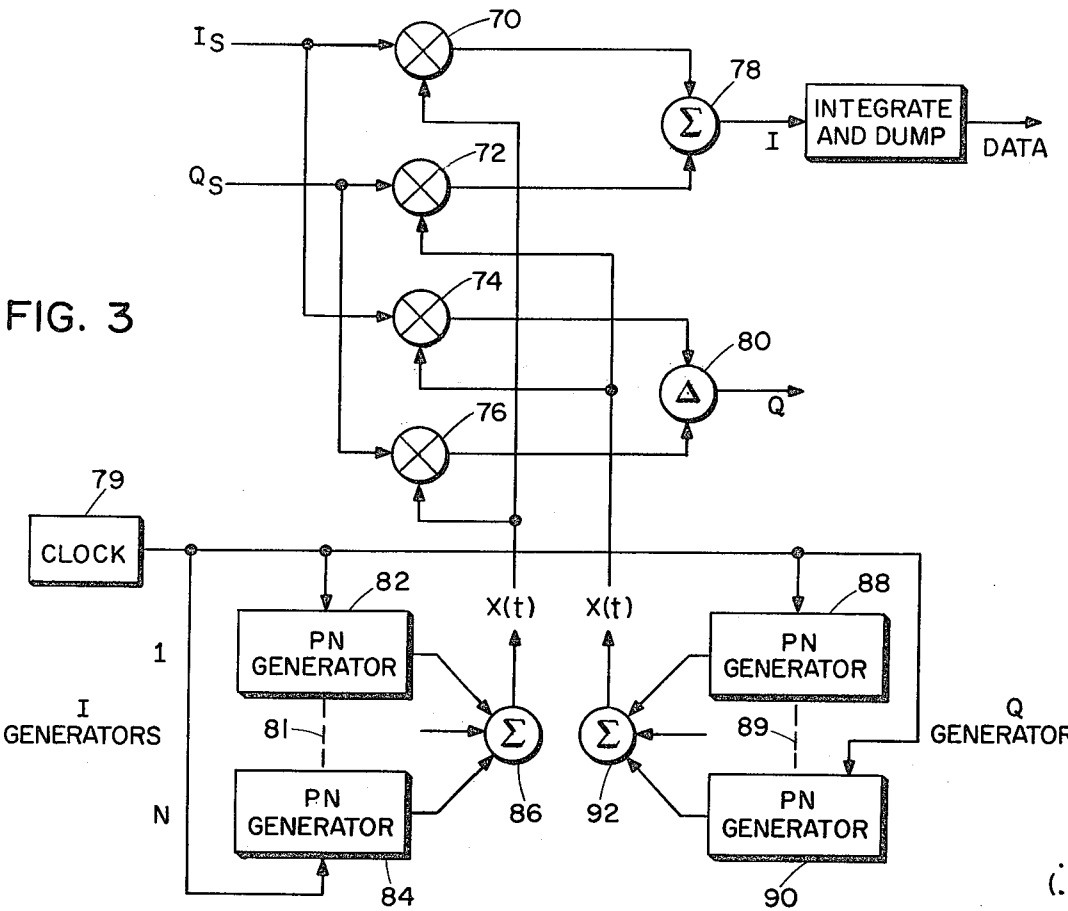
FIG. 3 is a block diagram of that portion of the receiver for demodulating the in-phase and quadrature baseband signal components of FIG. 2.

Refer now to FIG. 3 which shows receiver elements for demodulating the signal outputs of FIG. 2. Specifically, the in-phase baseband signal component is applied to mixers 70 and 74 and the quadrature baseband signal component is applied to mixers 72 and 76. Mixers 70 and 76 also receive the signal output from a summing circuit 86 which receives as inputs the outputs from PN generators 82 and 84 and intermediate generators designated by dash line 81. These generators comprise the in-phase bank of N generators which like the pN generators of FIG. 1 are preferably shift registers encoded respectively with the same codes of the generators of FIG. 1 and which are clocked by the clock 79 which has a pulse repetition frequency equal to that of the clock 18 of FIG. 1. In like manner, mixers 72 and 74 have applied thereto the output from summing network 92 which receives as inputs the output signals or codes of first PN generator 80 and the $N^{th}$ PN generator 96 and the intermediate generators designated by dash line 89. These comprise the quadrature section of PN generators, there being, of course, N generators in the section and being preferably shift registers encoded with the identical codes of the quadrature section of generators of FIG. 1. These generators are also clocked by the signal in clock 79. The generators are synchronized to those generators in the transmitter by means which are well known to those skilled in the art. For example, the transmitter might generate an unmodulated bud coded signal which will be compared with the code in the generators of the receiver. When the codes are aligned with one another, clock 79 is started thus maintaining the receiver generators synchronized with the transmitter generators. The output signals for mixers 70 and 72 are combined in summing circuit 78 to produce the demodulated in-phase component, while the output from mixers 74 and 76 are combined in the difference circuit 80 to produce the quadrature demodulated component in a manner well known to those skilled in the art.

Having explained this embodiment of my invention, various alterations and modifications thereof should now be obvious to one skilled in the art. Accordingly, the invention is to be limited only by the true scope and spirit of the appended claims.

The invention claimed is:

1. Means for providing a signal having noiselike amplitude and phase modulation coding for spread spectrum applications comprising:

at least a first plurality of pseudo noise generators, each of which generates a predetermined noiselike code signal;

a source of data;

first means for adding said data to each said noiselike code signal to produce a first plurality of data modulated noiselike signals;

a second plurality of pseudo noise generators, each of which generates a predetermined noiselike code signal;

means for generating a first carrier frequency;

means for shifting the phase angle of said carrier frequency by 90 degrees to provide a second carrier frequency;

second means for adding said data to each said noiselike code signal from said second plurality of pseudo noise generators to provide a second plurality of data modulated noiselike signals;

means for summing said first plurality of signals to provide a first sum signal, means for summing said second plurality of signals to provide a second sum signal;

means for mixing said first carrier frequency with said first sum signal to generate an in-phase signal component, means for mixing said second carrier frequency with said second sum signal to generate a quadrature signal component; and, means for combining said in-phase signal component with said quadrature signal signal component.

2. The means for providing a noiselike signal of claim 1 wherein said source of data comprises a source of binary data and wherein said first and second means for adding add said binary data to each said noiselike code signal.

3. The means for providing a noiselike signal of claim 2 wherein each said pseudo noise generator comprises a binary shift register, each of which is encoded with a predetermined binary code, and including a clock means for strobing said binary shift registers.

4. The means for providing a noiselike signal of claim 3 wherein the clock rate of said clock is very much faster than the data rate of said data source.

5. The means for providing a noiselike signal of claim 4 wherein the ratio of said clock rate with respect to said data rate is a whole number.

6. The means for providing a noiselike signal of claim 3 wherein each said binary shift register is encoded with a different predetermined binary code.

7. The means for providing a noiselike signal of claim 1 wherein the number of pseudo noise generators in said first plurality is equal to the number of pseudo noise generators in said second plurality.

8. The means for providing a noiselike signal of claim 7 including means for receiving said noiselike signal having third and fourth pluralities of pseudo noise generators, the number of pseudo noise generators in each plurality being the same.

9. The means for providing a noiselike signal of claim 8 wherein each said pseudo noise generator comprises means for generating a square wave, each of which is encoded with a predetermined binary code.

10. The means for providing a noiselike signal of claim 9 wherein each said means for generating a square wave comprises a binary shift register, each of which is encoded with a predetermined binary code, and including clock means for strobing said binary shift registers.

* * * * *